US005592885A

United States Patent [19]

Young, Jr. et al.

[11] Patent Number: 5,592,885

[45] **Date of Patent: *Jan. 14, 1997**

[54] COLLAPSIBLE PALLET

[75] Inventors: Robson T. Young, Jr., Kirkland; Roger L. Thomas, Cedarville, both of Ill.

[73] Assignee: National Pallet LLC, Kirkland, Ill.

[ * ] Notice: The term of this patent shall not extend beyond the expiration date of Pat. No. 5,517,926.

[21] Appl. No.: 386,889

[22] Filed: Feb. 10, 1995

Related U.S. Application Data

[63] Continuation-in-part of Ser. No. 307,313, Sep. 16, 1994, Pat. No. 5,517,926.

[51] Int. Cl.[6] ..... B65D 19/00

[52] U.S. Cl. ..... 108/51.3; 108/56.1

[58] Field of Search ..... 108/51.3, 51.1, 108/56.1

[56] References Cited

U.S. PATENT DOCUMENTS

| | | | |
|---|---|---|---|
| 3,026,078 | 3/1962 | Simkins | 108/51.3 |
| 3,434,435 | 3/1969 | Achermann et al. | 108/51.3 |
| 3,628,469 | 12/1971 | Neitzke | 108/51.3 |
| 3,911,834 | 10/1975 | Quaintance | 108/51.3 |
| 3,952,672 | 4/1976 | Gordon et al. | 108/51.3 |
| 4,863,024 | 9/1989 | Booth . | |
| 4,927,026 | 5/1990 | Gossler et al. . | |
| 4,949,898 | 8/1990 | Nederveld . | |
| 5,176,090 | 1/1993 | Roberts et al. | 108/51.3 |
| 5,222,444 | 6/1993 | Yovell, Jr. et al. | 108/51.3 |
| 5,230,291 | 7/1993 | Juvik-Woods . | |
| 5,269,219 | 12/1993 | Juvik-Woods . | |
| 5,285,731 | 2/1994 | McIntyre | 108/51.3 |
| 5,327,839 | 7/1994 | Herring et al. . | |
| 5,329,861 | 7/1994 | McCarthy . | |
| 5,441,154 | 8/1995 | Youell, III | 108/51.3 X |

FOREIGN PATENT DOCUMENTS

| | | | |
|---|---|---|---|
| 2583383 | 12/1986 | France | 206/386 |

*Primary Examiner*—Peter M. Cuomo
*Assistant Examiner*—Janet M. Wilkens
*Attorney, Agent, or Firm*—DeWitt Ross & Stevens SC

[57] ABSTRACT

A collapsible pallet 10 includes a pallet base 12 and a plurality of elongated collapsible or foldable support members 30 connected to the pallet base 12. Each of the collapsible support members 30 are foldably connected to the lower surface 16 of the pallet base 12. The collapsible pallet 10 also includes support means for maintaining the collapsible support members 30 in upright position by holding the walls of the support member 30 separate. The collapsible pallet 10 may be stored and/or transported in its collapsed configuration, and then rapidly converted to its upright position by deploying the support means. The support means may take the form of foldable support flaps 42 which fold into the support members 30, or support blocks 52 which may be inserted within the support members 30.

31 Claims, 13 Drawing Sheets

COLLAPSIBLE PALLET

RELATED APPLICATION

This is a continuation-in-part of U.S. patent application Ser. No. 08/307,313 filed on Sep. 16, 1994, now U.S. Pat. No. 5,517,926 entitled COLLAPSIBLE PALLET, the entirety of which is incorporated by reference.

FIELD OF THE INVENTION

The present invention relates generally to pallets and more specifically to a collapsible or foldable pallet.

DESCRIPTION OF THE PRIOR ART

Pallets have been used for many years for supporting, storing and transporting boxes, crates, barrels, machinery and other items. Pallets are typically constructed by mounting wooden boards horizontally and parallel to each other on vertical wooden support slats. While functional in design and use, the weight, bulk and expense of wood have led to the desire to use a variety of alternative construction materials and develop new designs for pallets.

Prior art references which disclose a variety of designs and construction materials for pallets include U.S. Pat. No. 5,329,861 to McCarthy, which discloses a pallet comprising a platform and support members mounted to the bottom of the platform. The support members are generally U-shaped, contain cut-outs for access by forklifts and the like on all four sides of the pallet, and are given high compression strength by support blocks proportionally spaced along the length of the support members. Due to the cut-outs, these support blocks essentially function as the legs of the pallet. Rigidity is further provided by rigid end caps positioned at the ends of the support members.

U.S. Pat. No. 5,230,219 to Juvik-Woods discloses a pallet comprising a platform with plural U-shaped support members attached to the underside of the platform. Each support member contains a paper honeycomb support block to lend high compression strength. U.S. Pat. No. 5,230,291 also to Juvik-Woods discloses a pallet comprising a platform and a single-piece support base which is folded to produce U-shaped support members thereon. The support base is folded and affixed to the underside of the platform. Each support member may accommodate a paper honeycomb support block for rigidity.

U.S. Pat. No. 5,327,839 to Herring et al. discloses a pallet comprising a platform supported by support runners, pedestal-type support blocks, and cross-beams, each of which is made of multiple ply corrugated cardboard.

Although these prior art pallets obviate some of the problems related to the expense and weight of wood pallets, they do little to relieve the problem of the bulk associated with pallets. Pallet bulk reduces storage space which otherwise might be used by cargo, and such bulk is particularly problematic with respect to the transportation and storage of empty pallets. The prior art contains several attempts to overcome the bulk problem.

Initially, the prior art discloses collapsible boxes which have palletized bases, such as those of U.S. Pat. No. 4,927,026 to Gossler et al. and U.S. Pat. No. 4,949,898 to Nederveld. The boxes collapse to rest in a folded state on their palletized bases. However, while these patents disclose solutions to reducing the bulk of boxes and storage containers associated with pallets, they do not disclose or suggest any solutions to reducing the bulk of the pallets themselves.

One attempt to reduce the bulk of pallets is disclosed in U.S. Pat. No. 4,863,024 to Booth, which is directed to a collapsible pallet constructed mostly from corrugated cardboard. Booth discloses a platform and two or more U-shaped channels all formed out of a single piece of appropriately folded corrugated cardboard sheet. In operation, the shape of the channels is achieved and maintained by inserting removable support blocks into the entire length of each channel, and then inserting removable wooden cross-beams perpendicularly to the channels through appropriately aligned cross-beam cutouts in the channels and support blocks. To collapse the Booth pallet, both the cross-beams and the support blocks are removed from the channels, and the pallet may then be unfolded to its original sheet form.

While providing some advantages over the existing prior art designs, the collapsible pallet disclosed in Booth has some disadvantages with respect to its efficiency in use and cost of manufacture. Specifically, the Booth pallet requires assembly and disassembly of multiple parts, making handling difficult and time-consuming. Also, the pallet base may be folded flat but the cross-beams and support blocks may not be, making storage inefficient. Further, Booth requires precisely aligned cross-beam cutouts in both the channels and in the support blocks, and such precision cutouts add to manufacturing costs as well as assembly time.

SUMMARY OF THE INVENTION

The present invention sets forth a design for a collapsible pallet which is advantageous over the designs of the prior art and which has not heretofore been known or taught in the art.

The present invention is directed to a collapsible support member adapted to be attached to a pallet base, the support member having a generally rectangular shape defined by opposing first and second ends and opposing first and second sides, the support member comprising contiguous foldably attached walls defining an upper wall, a lower wall, and first and second opposing side walls, wherein the upper wall and lower wall are foldably connected to the first and second side walls to form an internal channel having two opposing ends; and at least one foldable support flap integrally connected to one of the walls and adapted to fold inwardly into the channel, the support flap having an edge adapted to be positioned against an opposing wall to maintain the walls in spaced relation.

The present invention is also directed to a collapsible pallet comprising a pallet base having upper and lower surfaces; and at least two elongated collapsible support members attached to the pallet base, each support member including contiguous foldably attached walls defining an upper wall, a lower wall, and first and second opposing side walls, wherein the upper wall and lower wall are foldably connected to the first and second side walls to form an internal channel having two opposing ends, the walls including at least one foldable support flap adapted to fold inwardly into the channel, the support flap having an edge adapted to be positioned against an opposing wall to maintain the walls in spaced relation.

The present invention is further directed to a collapsible pallet comprising a pallet base having an upper surface, a lower surface, a first end, a second end, and first and second opposing sides; and at least two elongated collapsible support members connected to the pallet base, each support member including an upper wall, a lower wall, and first and second opposing side walls, wherein the lower wall is foldably connected to the first and second side walls and the upper wall is foldably connected to at least one of the first and second side walls to define an internal channel having two opposing ends, and wherein each support member further includes at least one folding support flap.

The present invention is additionally directed to a collapsible pallet comprising a planar pallet base having an upper surface, a lower surface, a first end, a second end, and first and second opposing sides; at least two elongated support members attached to the pallet base and spaced in parallel position to define a fork channel therebetween, wherein each support member includes an upper wall, an opposing lower wall, and opposing first and second side walls therebetween, wherein the upper wall and lower wall are foldably connected to the first and second side walls to define an internal channel; at least one folding support flap on each support member, the folding support flap being adapted to fold into the internal channel and abut at least two opposing support member walls; and at least one support compartment within each internal channel, the support compartment being adapted to receive a support block therein in a snug-fit manner.

The present invention is still further directed to a collapsible pallet comprising a pallet base portion having an upper surface, a lower surface, a first end, a second end, and two opposing sides with support member portions extending therefrom, the support member portions including at least three integrally connected wall areas adapted to fold to define an internal channel, wherein at least one wall area includes a support flap adapted to fold within the internal channel and hold at least two wall areas separate.

The collapsible pallet of the present invention provides a pallet which is economical to manufacture, light in weight, strong and safe in operation, and which is easy to assemble, use, reuse, disassemble, and dispose.

The collapsible pallet can be constructed entirely out of corrugated cardboard and similar inexpensive and readily available materials. Additionally, the collapsible pallet of the present invention is as strong as prior art pallets which use both wood and non-wooden materials, but it uses less of such materials and is easier to assemble and disassemble.

Even when made of cardboard, the collapsible pallet compares favorably to wood pallets in both load-bearing (compressive) and side-shifting (shear) strength. In its various embodiments, the collapsible pallet is suitable for carrying loads ranging from approximately 200 pounds up to approximately 4000 pounds. As an example, a collapsible pallet made of single-ply corrugated cardboard and measuring 42×42 inches and 4 inches high can collapse to a height of 1 inch or less, weighs less than 7 pounds, and yet it may support a weight of over 500 pounds. To increase the load-bearing capacity, a user need only add additional support means such as support flaps or support blocks, support members, or pallet bases to the collapsible pallet, or utilize stronger materials for the pallet's construction.

The collapsible pallet may be converted back and forth from a collapsed form to a pallet without requiring significant assembly or disassembly. In its simplest embodiment the pallet is collapsible without having to be disassembled into separate pieces. The foldable support flaps may be deployed to grant the support members of the collapsible pallet significant load-bearing and side-shifting strength, yet they also may be undeployed to allow the collapsible pallet to be collapsed to a flat form. In alternative embodiments, removable support blocks may be inserted within the support members to grant additional strength. These support blocks may later be removed if the pallet is to be collapsed, and certain embodiments of the support blocks themselves unfold to a flat state. Therefore, the collapsible pallet may be efficiently stored as a flat, single-piece unit and converted to a pallet when it is needed to support cargo. As an example, the pallet may be used to ship cargo, knocked down to a flat state at its point of arrival, and shipped back to its point of origin in a flat state to save cargo space.

While the collapsible pallet is durable enough to be folded and unfolded time and time again for storage and reuse, it is also inexpensive enough to be discarded without significant economic loss. Additionally, when the pallet is damaged, it can be recycled rather than disposed of in a landfill. This feature is a valuable one, since the user may sell the damaged pallet as raw recyclable material rather than paying to have it disposed of as trash.

Because it may be made of light, semi-flexible materials, the collapsible pallet has shock resistant qualities which protect fragile materials from breakage during transport. Additionally, the collapsible pallet is safe for workers to assemble and otherwise handle, since the pallet will not splinter or fragment into sharp-tipped particles. Such a feature is valuable to workers who are often subjected to splinters or cuts from pallets made of wood and similar materials.

Further objects, features, advantages and uses of the present invention will be apparent from the following detailed description when considered in conjunction with the accompanying drawings.

DETAILED DESCRIPTION OF THE INVENTION

Figure 1:
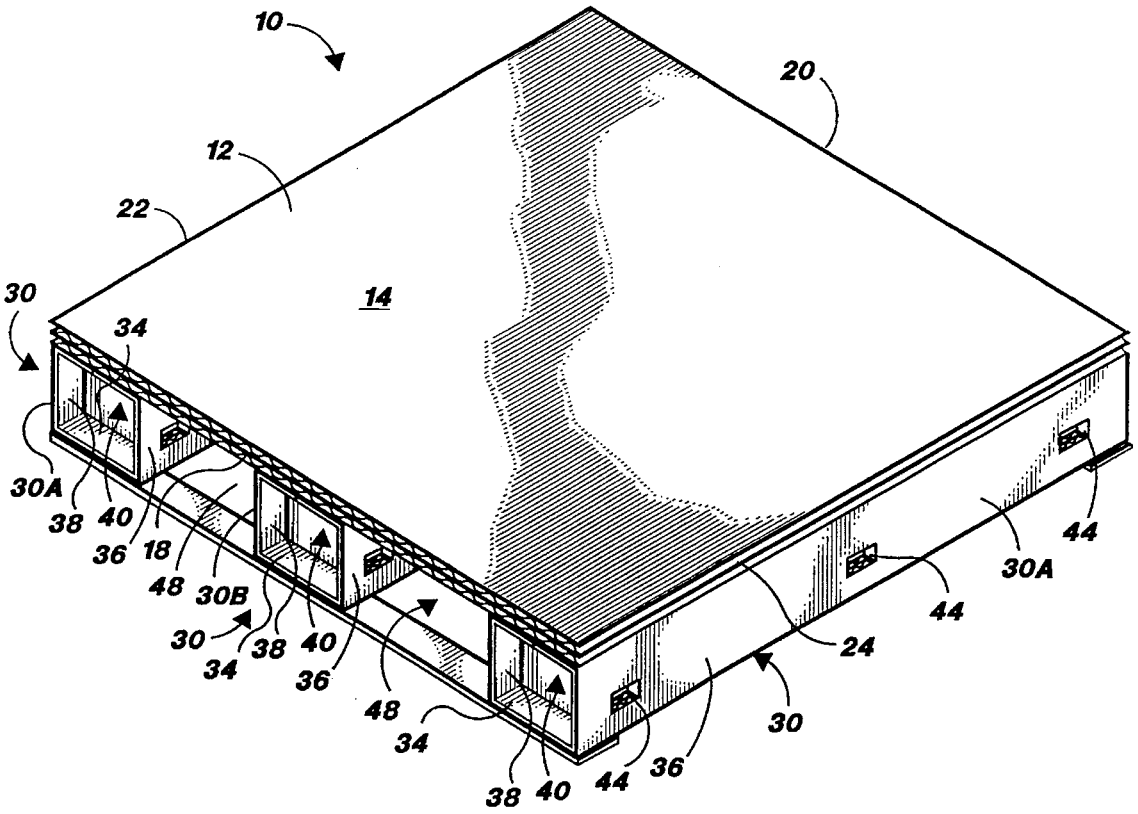
FIG. 1 is a perspective view of the pallet of the present invention.

Referring now to the drawings, in which the same or similar features are given the same reference numbers throughout the several figures, FIGS. 1–5 illustrate a collapsible pallet 10 of the present invention. The collapsible pallet 10 may be constructed from a variety of standard materials known to the art, including wood, plastic, fiberglass and conceivably even aluminum or steel. However, the present invention is preferably constructed from a refoldable material, which for purposes of this invention is considered to include materials which may be folded back and forth at a fold line through multiple folding cycles without degrading the structural integrity of the material at the fold line. Such refoldable materials include fiberboard products such as corrugated cardboard, plastic sheet products such as corrugated plastic sheet, and a variety of composite cellulosic-plastic materials or laminated fiberboard materials known to the art.

The collapsible pallet 10 is most preferably constructed of fiberboard materials. As used herein, the term "fiberboard" refers to and includes fiberboard, cardboard, chipboard, paperboard, paper honeycomb, and similar paper products in sheet or corrugated form that are relatively stiff and capable of withstanding substantial loads when used to produce the collapsible pallet of the present invention. The fiberboard material may also be derived from recycled materials including cardboard, paper, sawdust and other cellulosic waste materials, and the like. Advantageously, the use of fiberboard materials renders the collapsible pallet 10 readily recyclable and/or biodegradable. Further, these materials are relatively inexpensive and easy to cut and fold using standard manufacturing techniques.

While it is understood that the collapsible pallet 10 of the present invention may be made from a variety of materials, the present invention will be described with reference to corrugated fiberboard material.

The collapsible pallet 10 includes a planar pallet base 12 having an upper surface 14, a lower surface 16, a front end 18, a rear end 20, and first and second opposing sides 22 and 24, respectively. The pallet base 12 may be constructed of a single sheet of fiberboard. Alternatively, as shown in FIGS. 1–5, the pallet base 12 may be constructed of multiple adhered sheets of fiberboard in order to increase the strength of the pallet base 12. A typical pallet base 12 may be constructed with any size, shape, and aspect ratio suitable for the intended purpose. Typical sizes and shapes include square or rectangular shapes between 30"×30" to 60"×40". Other sizes and shapes are available depending the conventions of the industry.

Attached to the pallet base 12 are a plurality of elongated collapsible support members 30, which are connected to the lower surface 16 of the pallet base 12. At least two support members 30 are required. Conventionally, three support members 30 are utilized for each collapsible pallet 10, with two external support members 30A on either side of a central support member 30B. However, the number of support members 30 is not a critical aspect of the collapsible pallet 10, and it may be varied to suit a particular use. The present invention includes collapsible pallets 10 using a variety of sizes and different numbers of support members 30.

Figure 2:
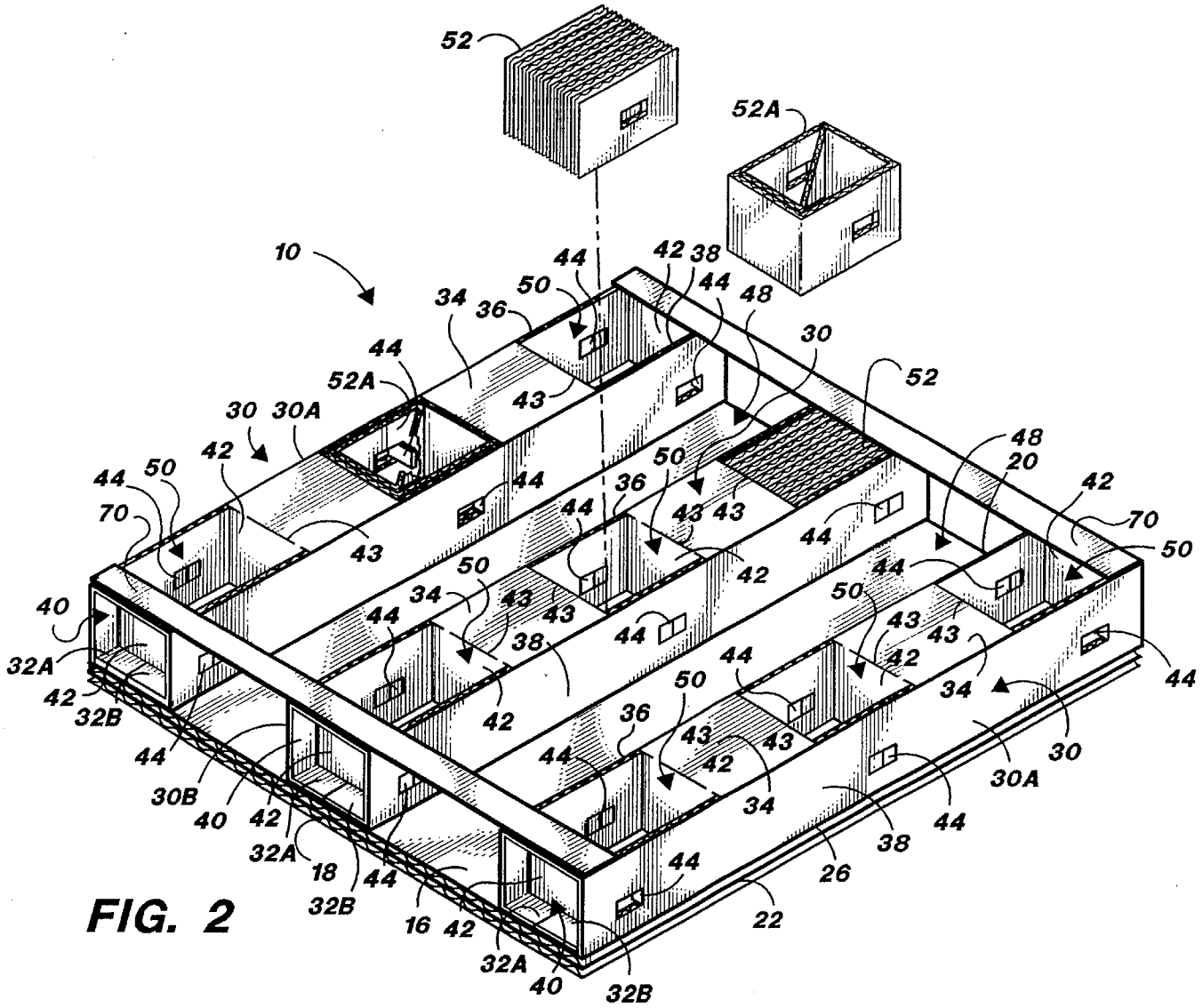
FIG. 2 is a perspective view of the underside of the pallet of FIG. 1.
Figure 3:
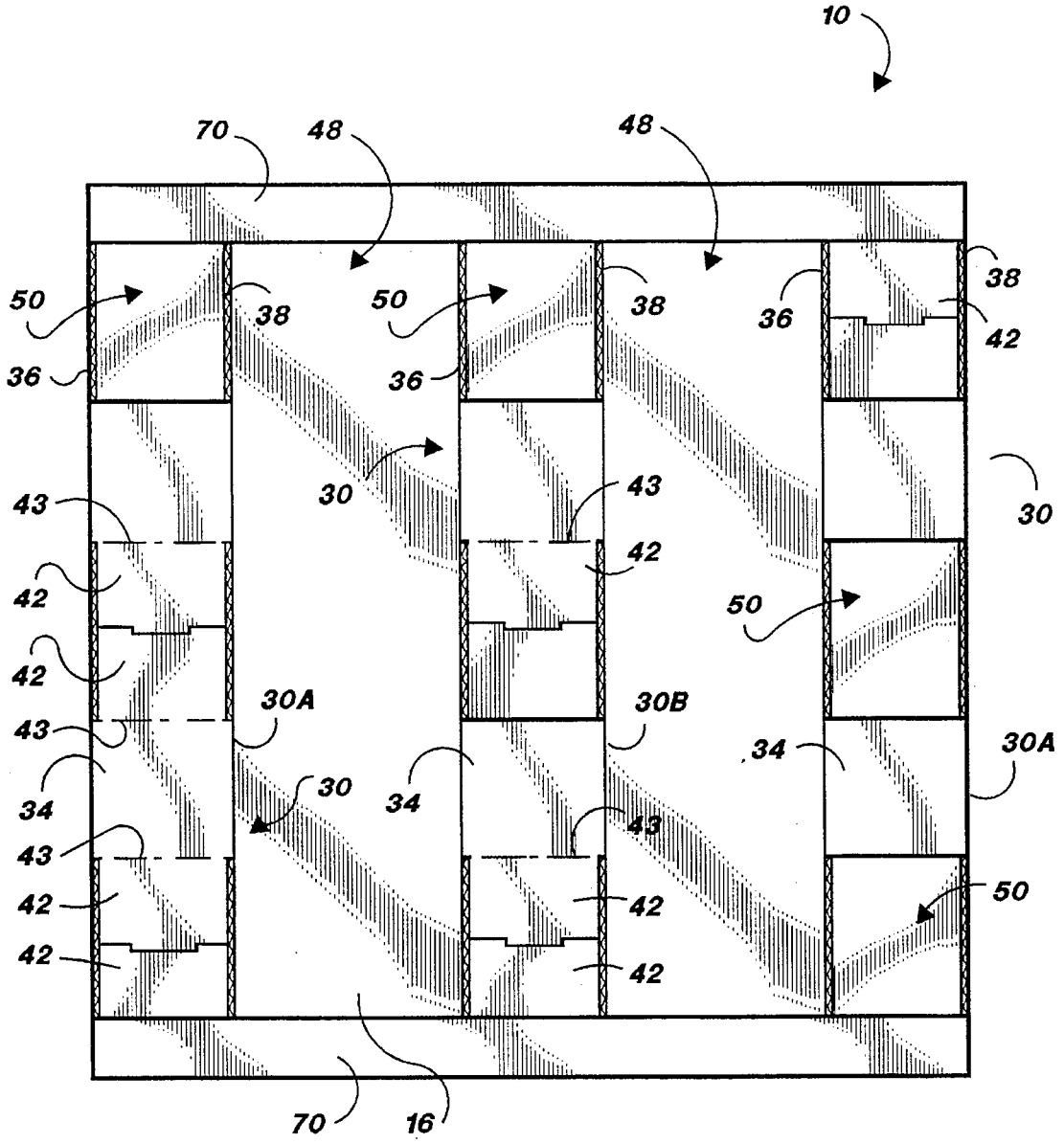
FIG. 3 is a bottom elevated view of the pallet of FIG. 1.
Figure 4:
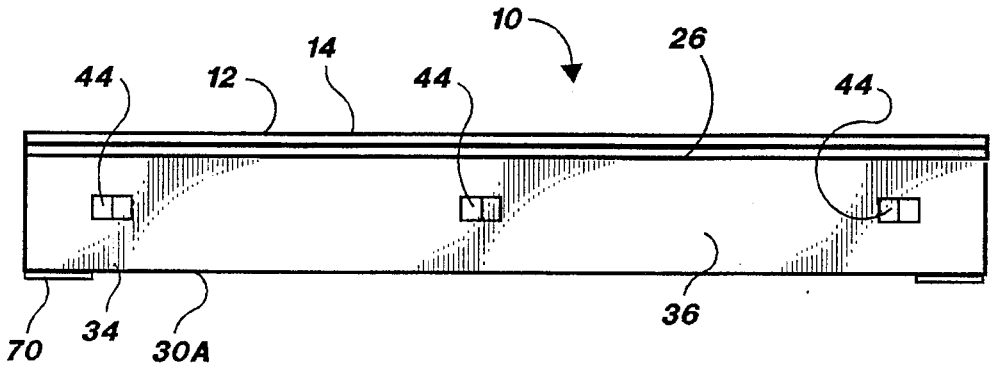
FIG. 4 is a side elevated view of the pallet of FIG. 1.
Figure 5:
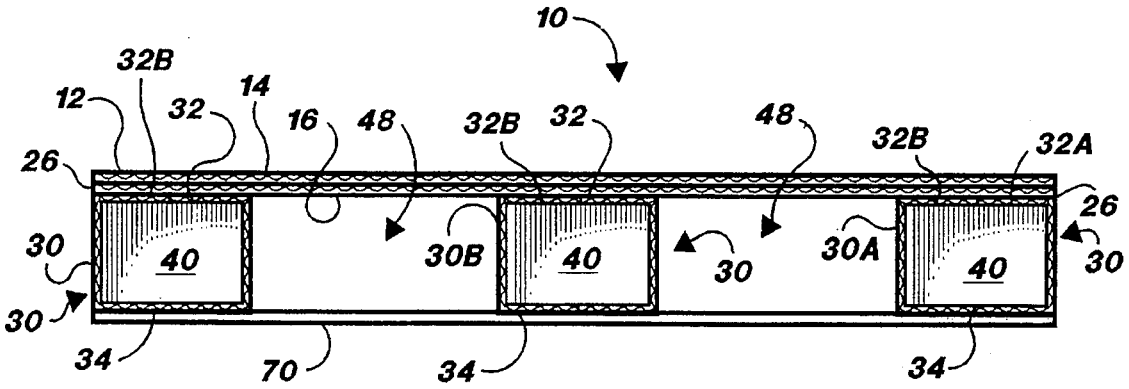
FIG. 5 is an end elevated view of the pallet of FIG. 1.
Figure 6:
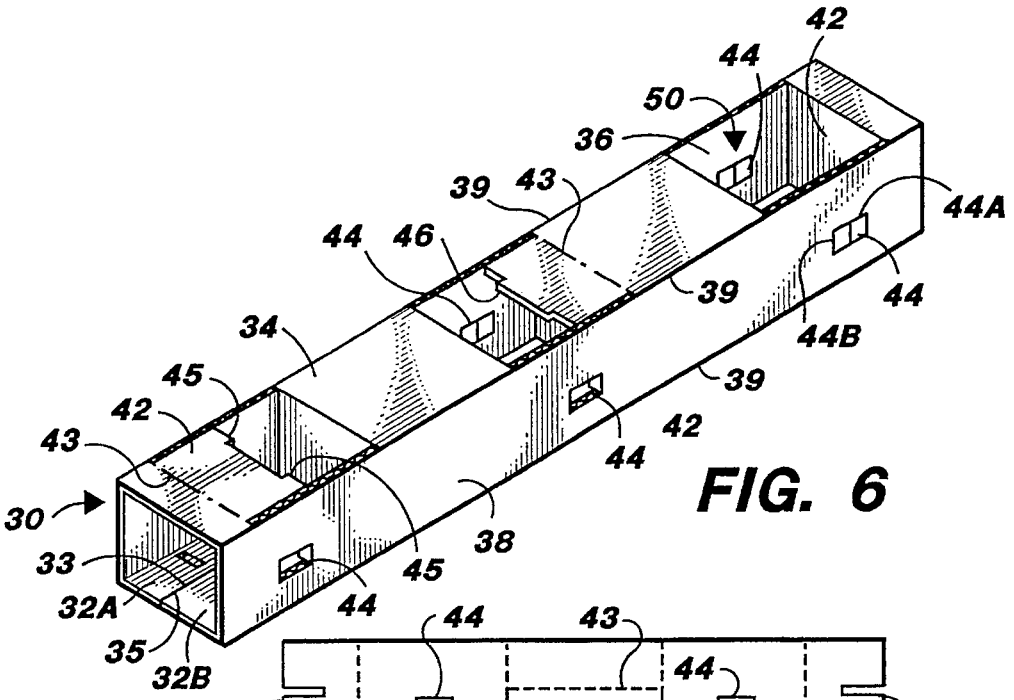
FIG. 6 is a perspective view of the underside of a support member of the pallet of FIG. 1.
Figure 7:
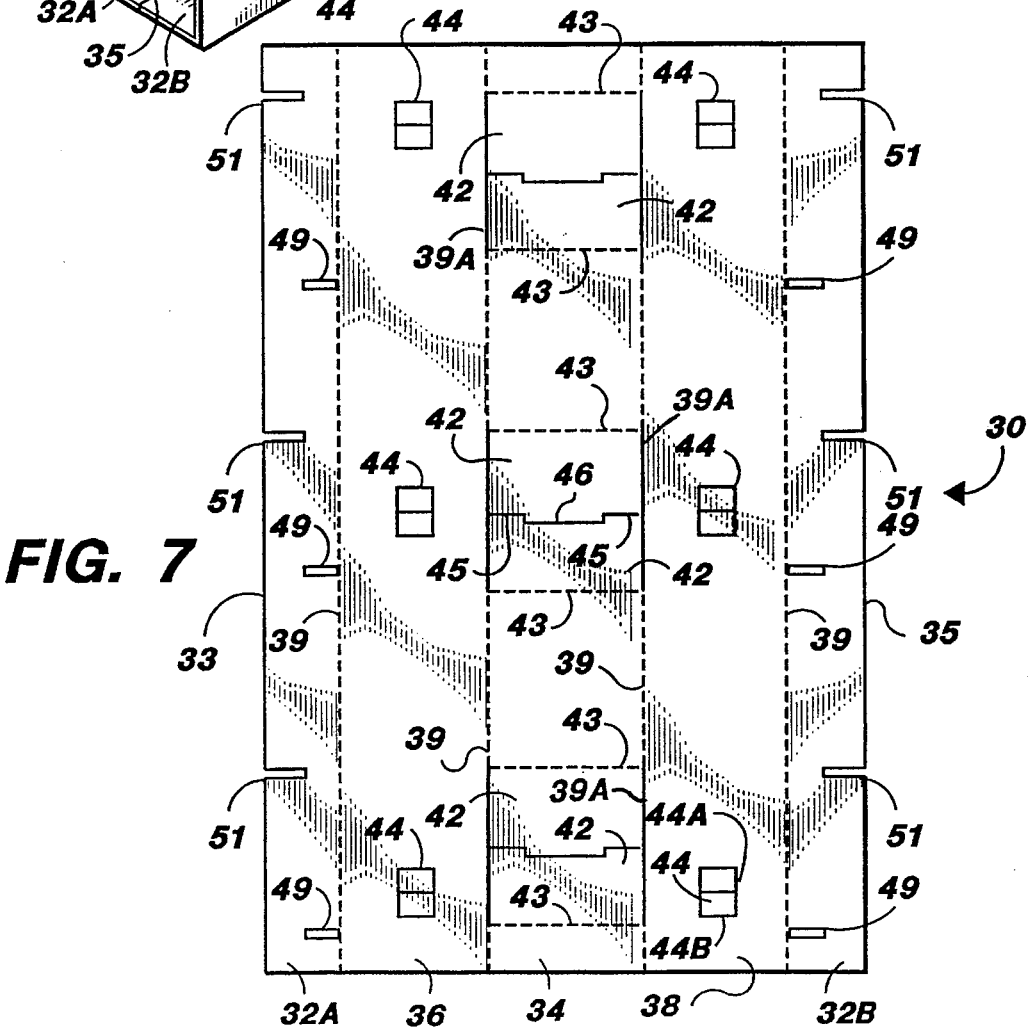
FIG. 7 is a top plan view of the unfolded support member of FIG. 6.

Referring now specifically to FIGS. 2, 6 and 7 there is illustrated a preferred embodiment of the support members 30 of the present invention. The support members 30 include two upper walls 32A and 32B designed for attachment to the lower surface 16 of the pallet base 12, a lower wall or floor surface 34, and opposing first and second side walls 36 and 38. In the preferred embodiment of the collapsible pallet 10, wherein the pallet material is corrugated fiberboard, each support member 30 is comprised of one sheet of corrugated fiberboard material which may be stamped and cut according to the specifications illustrated in FIG. 7. While the width, height and length of the support members 30 may be varied to suit a particular design need, the height of the side walls 36 and 38 is typically from 2–4 inches (5–10 cm) to provide enough elevation to enable the forks of a forklift, hand truck, or hand jack to be maneuvered under the pallet 10. The width of the support members 30 along the lower wall 34 is typically from 3–8 inches (7.5–8 cm). Support members 30 with lesser width can support a greater load, but provide less support area for the pallet base 12. Thus, multiple support members 30 of the same or different sizes may be used on a collapsible pallet 10 to suit its particular load requirements.

Figure 11:
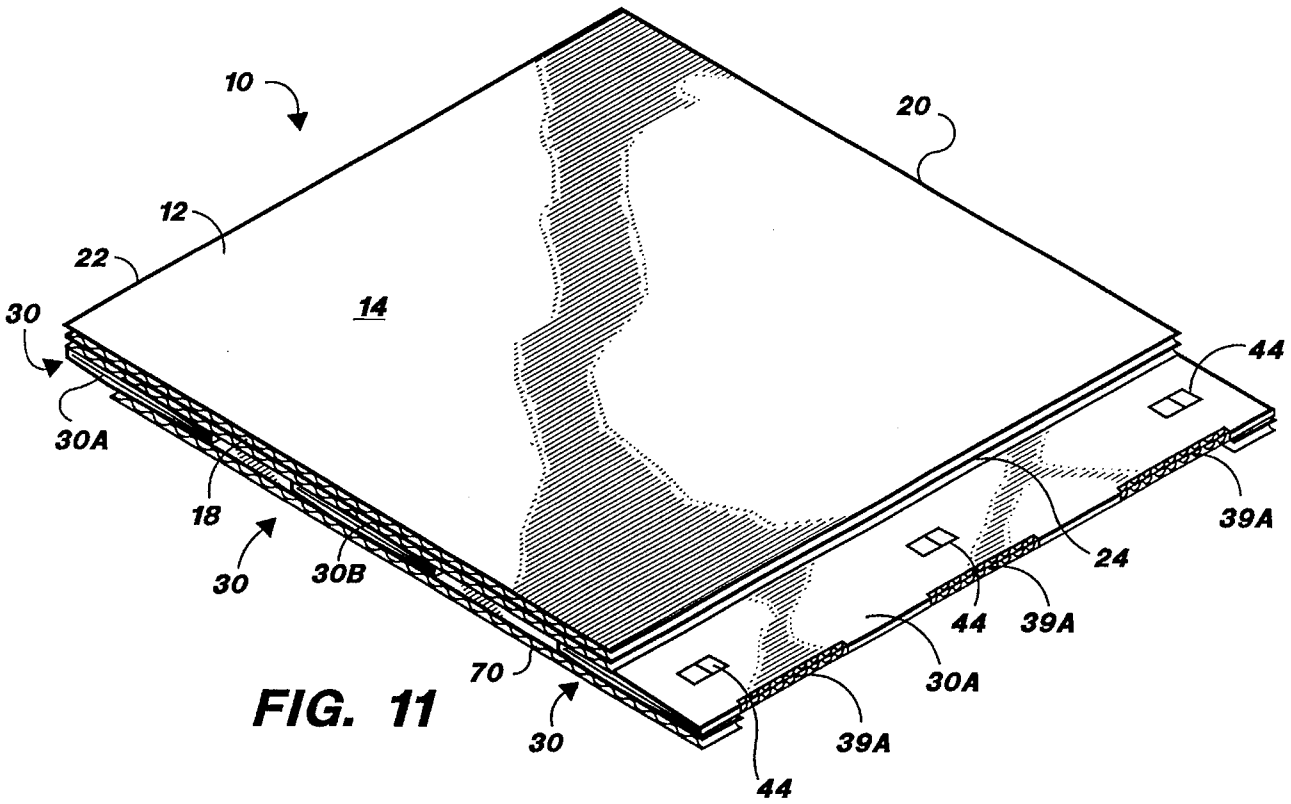
FIG. 11 is a perspective view of the pallet of FIG. 1 in folded condition.
Figure 14:
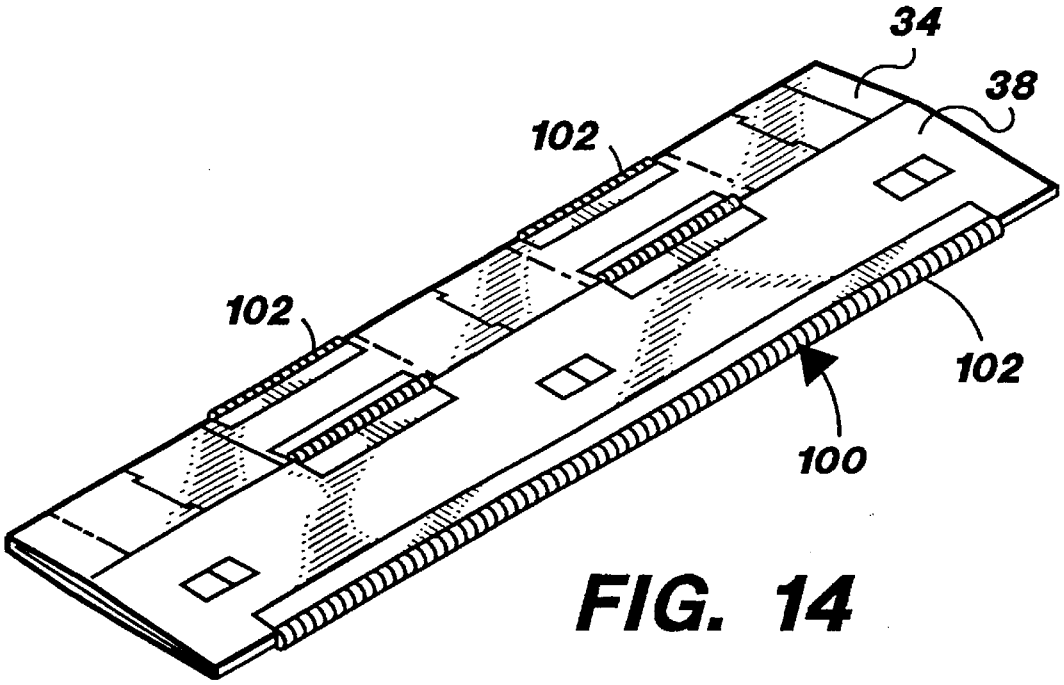
FIG. 14 is a perspective view of an alternative embodiment of a folded support member illustrating a hinged support.

The support members 30 are provided with fold lines 39, or a combination of fold lines 39 and score lines 39A, as illustrated in FIG. 7, to allow the support member 30 to fold from the planar form illustrated in FIG. 7 to the box-like form illustrated in FIG. 6, and also to fold to the collapsed form illustrated in FIGS. 11 and 14.

Referring again to FIG. 7, the upper walls 32A and 32B of the support members 30 each respectively include exterior edges 33 and 35. The upper walls 32A and 32B are preferably (though not necessarily) sized in the transverse direction so that when the support member 30 is folded in the manner illustrated in FIG. 6, the exterior edges 33 and 35 abut each other. This preferably places the side walls 36 and 38 in parallel relationship, and also places the lower wall 34 parallel to the upper walls 32A and 32B.

If a user desires to form a free-standing support member 30 as illustrated in FIG. 6, the edges 33 and 35 may then be joined by attachment means including adhesives such as polyvinyl acetate, heat sealing materials such as polypropylene, stitches, tape, staples or other attachment means known to the art. The attachment means, much like the materials used to construct the support member 30, may be chosen for recyclability or biodegradability. For example, the attachment means may include water-based glues, e.g., hide glue, mucilage, etc. which allow the support member 30 to be easily deconstructed. Alternatively, the edges 33 and 35 may be left unattached, and the upper walls 32A and 32B may be attached directly to the lower surface 16 of the pallet base 12. In this case, the upper walls 32A and 32B may be attached to the lower surface 16 of the pallet base 12 by a variety of attachment means known to the art, the preferred example being adhesives.

The support members 30 are preferably located in parallel relation to each other. Additionally, it is recommended that the external side walls 36 or 38 of the external support members 30A be located in alignment with the sides 22 and 24 of the pallet base 12. By locating the external support members 30A in this manner, two advantages are gained; first, the pallet base 12 does not overhang the support members 30A at the sides 22 and 24 and create a lip which is capable of catching on other objects when the collapsible pallet 10 is transported, and second, multiple collapsible pallets 10 may easily be placed in a row in abutting side-to-side relation without interference from such a lip. The central support member 30B is preferably positioned centrally on the pallet base 12 and in spaced parallel relation to the external support members 30A, as illustrated in FIGS. 1 and 2. The spaced positioning of the support members 30 allows for the creation of fork channels 48, which will be described later in the specification.

After the exterior edges 33 and 35 are attached to form a free-standing support member 30, or after the upper walls 32A and 32B are attached to the pallet base, the fold lines 39 allow the support member 30 to be positioned from a flattened position as illustrated in FIGS. 11 and 14 to an upright position as illustrated in FIGS. 1, 2 and 6. The side walls 36 and 38, and the lower wall 34 and upper walls 32A and 32B, remain in parallel relation as the support member 30 is collapsed or placed erect.

Referring now to FIGS. 2, 3, 5 and 6, each support member 30 in its assembled state includes an internal channel 40 and at least one type of support means for supporting the support member 30 in an upright position. The support means maintains the support member 30 in a rigid upright state and keeps the support member 30 from folding to a flat, collapsed state as illustrated in FIGS. 11 and 14.

The preferred support means includes at least one and preferably a plurality of folding support flaps 42 integrally connected to the support member 30. Preferably, the support flaps 42 are integrally connected to the lower wall 34 of the support member 30. However, the support flaps 42 may also or instead be integrally connected to either of the opposing side walls 36 or 38 of the support member 30, or even on the upper walls 32A and 32B.

When the collapsible pallet 10 of the present invention is constructed from a foldable material, such as corrugated fiberboard, each support flap 42 is essentially a scored or cutout flap attached to wall 34 by means of fold line 43. In this preferred manner, the support flap 42 may be inwardly folded about the fold line 43 and into the internal channel 40 to provide a supporting column between the first and second side walls 36 and 38. When this is done, the support flaps 42 maintain the support member 30 in the upright position and provide both compressive strength and protection against side-shifting.

While one support flap 42 can achieve this purpose, it is preferred to have two or more folding support flaps 42 on each support member 30 to provide strength to the support member 30 in its upright position. The optimal number of support flaps 42 within the support member 30 is determined in accordance with the desired load-carrying capacity of the collapsible pallet 10. In the most preferred embodiment of the support member 30, at least six support flaps 42 are used to grant the support member 30 a load carrying capacity of over 500 pounds.

As illustrated in FIGS. 6 and 7, the support member 30 may be provided with locking tongues 45 and/or 46 to allow placement of the support flap 42 into receiving slots 49, 51, respectively, in the upper walls 32A and 32B. In this manner, each support flap 42 may be lock-fit within the internal channel 40 to provide additional integrity for the support member 30. When opposing support flaps 42 are rotated into locking position in the internal channel 40, a support compartment 50 is provided in the support member 30 between each pair of support flaps 42.

Referring now to FIGS. 2, 8, 9 and 10, the present invention may also be provided with support means in the form of support blocks 52 which may be placed into the support compartments 50 to grant the support members 30 added structural integrity. As illustrated in FIG. 2, there are preferably three support compartments 50 for each support member 30 of a standard or regulation size pallet 10. The number of support compartments 50 in a support member 30 may be increased or decreased depending upon the length of the support member 30 and the desired load-carrying capacity of the pallet 10.

Figure 8:
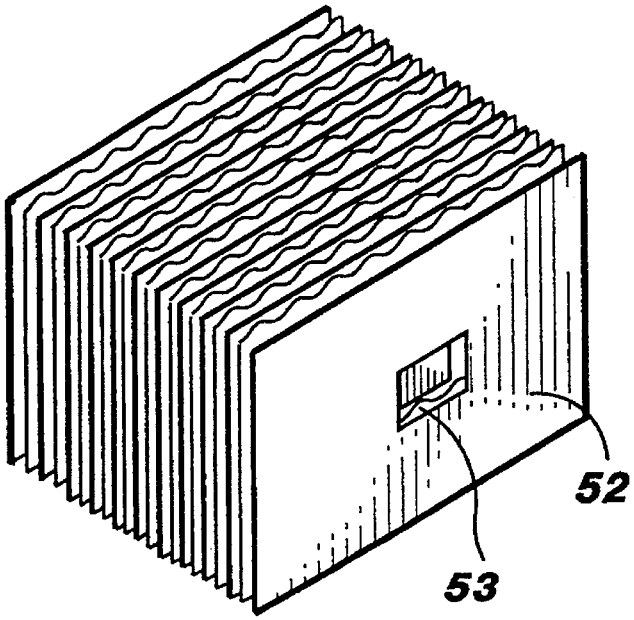
FIG. 8 is a perspective view of one embodiment of a support block of FIG. 1.

Referring to FIG. 8, the support block 52 may be a solid block consisting of multiple plies of adhered corrugated fiberboard. It is within the scope of the present invention to use other formed materials, synthetic or natural, for the support block 52. Examples of such materials are corrugated or solid fiberboard, honeycomb material, wood, or plastics such as rubber, urethane foam or foamed polystyrene, or any of these materials in composite or molded form.

The support block 52 should preferably be of sufficient length, width and height to provide a snug-fit relationship into the support compartment 50. Specifically, the height of the support block 52 is substantially equal to the height of the opposing side walls 36 and 38 of the support member 30, the width of the support block 52 is substantially equal to the width of the lower wall 34 and the combined width of the upper walls 32A and 32B, and the length of the support block 52 is substantially equal to the length of the support compartment 50 between fold lines 43. As such, the support block 52 is sized to frictionally adhere to the internal walls of the support compartment 50.

However, the support blocks 52 may, in an additional or alternative embodiment, be secured in the support compartments 50 by additional means beyond frictional forces. For example, as shown in FIG. 6, folding locking tabs 44 formed by score lines 44A and fold lines 44B on the side walls 36 and 38 of the support members 30 may be provided to assist in releasibly securing the support block 52 in the support compartment 50. The locking tabs 44 may be folded away from the side walls 36 and 38 about the fold lines 44B and into the support compartment 50 to engage a support block 52 therein. If locking tabs 44 are used, the support block should be modified to include openings 53 to receive each locking tab 44. The locking tabs 44 will thereby restrain the support block 52 within the support compartment 50.

Figure 9:
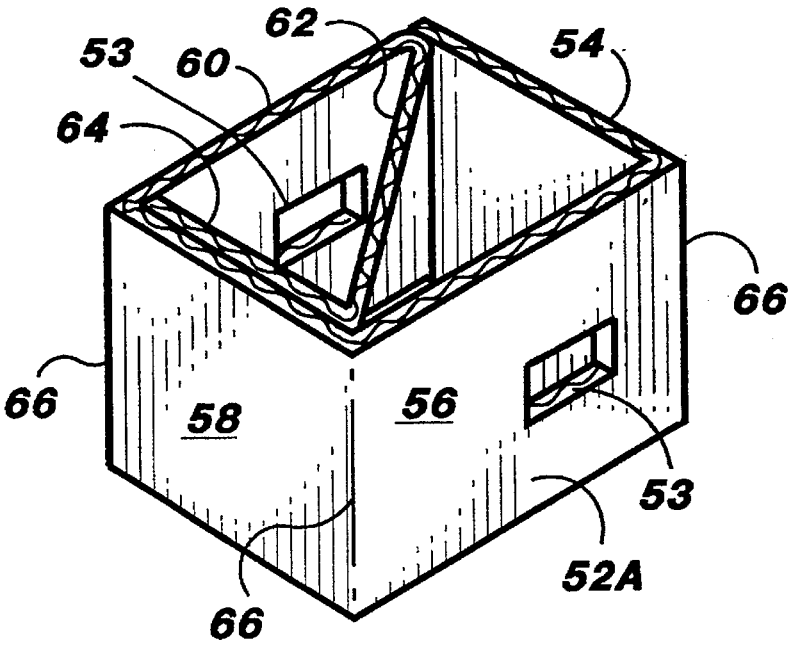
FIG. 9 is a perspective view of a second embodiment of the support block of FIG. 1.
Figure 10:
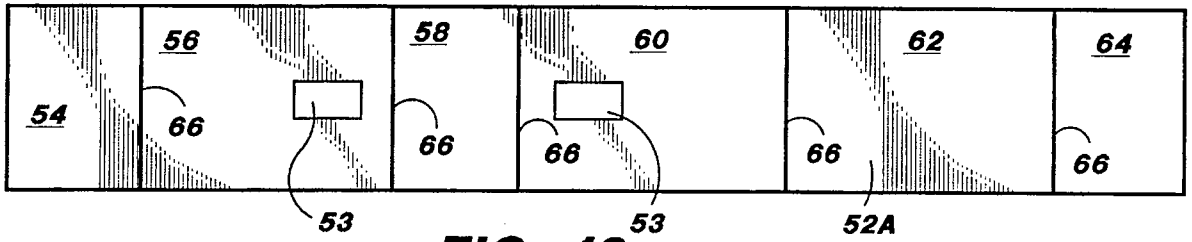
FIG. 10 is a top plan view of the unfolded support block of FIG. 9.

An alternative embodiment of the support block 52 is illustrated by support block 52A, illustrated in FIGS. 9 and 10. Support block 52A may be constructed of a single elongated member, as illustrated in FIG. 10. The support block 52A preferably comprises a single sheet of corrugated fiberboard forming a plurality of block walls 54, 56, 58, 60, 62 and 64 separated by fold lines 66. The dimensions of block walls 54–64 are sized appropriately to fit the dimensions of the support compartment 50. The support block 52A is folded as illustrated in FIG. 9 such that one wall 62 provides a diagonal bridge support to add to the structural integrity of the support block 52A. Of course, other single elongated members could be folded into alternative configurations which would serve the same function as the embodiment disclosed in FIGS. 9 and 10 and as described above. Advantageously, the support block 52A may be unfolded to a collapsed state and refolded for reuse within support compartment 50. Block walls 56 and 60 may be provided with openings 53 to receive the locking tabs 44 to releasibly secure the support blocks 52A to the support members 50.

Support means such as the support flaps 42 and the support blocks 52 allow an increase in the load-carrying capacity and side-shifting resistance of the collapsible pallet 10. Preferably, support blocks 52 or 52A are used in conjunction with other support means, such as the support flaps 42. However, it can be appreciated that when a support block 52 or 52A is used, it is not necessary to provide the support member 30 with support flaps 42 (and vice versa) and the support members 30 may be modified accordingly. As an example, if only the support block 52 or 52A is used as support means, the support flaps 42 may be omitted and the support compartments 50 may be formed by cutout portions in the lower wall 34, or alternatively in either of the opposing side walls 36 and/or 38 of the support member 30. Locking tabs 44 or frictional means may then be used to retain the support block 52 or 52A within the support compartments 50.

As illustrated in FIG. 2, the collapsible pallet 10 may also provided with at least one crossbeam 70 affixed to the surface of the lower wall 34 of the support members 30. The crossbeam 70 is a longitudinal support member adapted to attach to all of the support members 30 in order to provide structural integrity to the support members 30 in both the upright and the flattened position. As shown in the Figures, the crossbeam 70 preferably engages all support members 30 at a perpendicular angle, though such an orientation is not required. At least one, but preferably two or more, crossbeams 70 are preferred. As illustrated, the crossbeam 70 can be constructed of similar material as the rest of the collapsible pallet 10. However, the crossbeam 70 is preferably made of thin fiberboard, metal, or plastic material so that hand trucks, forklifts, floor jacks and similar devices are able to easily roll over the crossbeam 70. The crossbeam 70 can be adhered to the support members 30 by adhesives, staples or other previously described attachment means.

Reference is now made to FIG. 11 which illustrates the collapsible pallet 10 in collapsed or folded form. Without the supporting capability of support means such as the support flaps 42 or the support blocks 52, the collapsible pallet 10 can be folded and collapsed to a substantially flattened form. Therefore, the support flaps 42 may be folded out of the internal channel 40, and/or the support blocks 52 or 52A maybe removed from the support compartments 50, to enable the pallet 10 to be collapsed and more conveniently stored and transported. Additionally, the support block 52A can be stored and transported in either an upright or flattened form. In the flattened form, a number of support blocks 52A can be stored within the support members 30 or alongside the collapsible pallet 10 during storage and transportation. The ability to store the support blocks 52A in unfolded, flattened form within the collapsed pallet 10 offers significant advantages over the prior art collapsible pallets. Specifically, in addition to the fact that no additional space is necessary to store the support blocks 52A during transport, storing the support blocks 52A within the collapsed pallet 10 during transport ensures that the support blocks 52A are also readily available when the collapsed pallet 10 is to be converted to its useful, upright form. When it is desired to convert the collapsible pallet 10 to its upright form, the support members 30 are moved to an upright position, as illustrated in FIGS. 1 and 2, and supported by the deployment of the support flaps 42 into the internal channel 40. If necessary or desired for increased rigidity, the support members 30 may be further strengthened by inserting the support blocks 52 or 52A.

When the collapsible pallet 10 is positioned for use by folding the support members 30 as illustrated in FIG. 1, it can be used as a typical pallet. The collapsible pallet 10 includes fork channels 48 defined by the space between each pair of support members 30. The fork channels 48 may accommodate the forks of a forklift, or floor jacks, hand trucks, or similar devices, from the front end 18 or rear end 20.

The collapsible pallet 10 may also use different embodiments of the support members in place of, or in addition to, the support members 30 described above. Examples of several of these alternative support members follow.

First, it is contemplated that the support members 30 need not be attached to the pallet base 12 at their upper walls 32. Since the support members 30 are collapsible and have substantial load-carrying capacity at any orientation, the support members 30 may be rotated from the positions shown in the Figures, and other support member 30 walls such as the side walls 36 and 38 or the lower wall 34 may be attached to the pallet base 12 instead. If this is done, care must be taken not to render the support flaps 42, the locking tabs 44, or similar folding parts unusable by affixing them to the pallet base 12.

Second, it is contemplated that an upper wall 32 for attaching the support members 30 to the pallet base 12 may be altogether omitted from the support members 30. As an example, although the support member 30 is shown in the accompanying drawings as comprising upper walls 32A and 32B for attaching the support member 30 to the pallet base 12, it is within the scope of the present invention to omit the upper walls 32 and attach the opposing first and second side walls 36 and 38 of the support member 30 directly to the pallet base 12. In such a case, a side wall 36 or 38 may be integrally attached to the pallet base 12, or tape or other flexible attachment means may be used to attach the side walls 36 and 38 to the pallet base 12.

Third, it is contemplated that the upper walls 32A and 32B of the support members 30 may be of different sizes. In FIGS. 1–3 and 5–7, the upper walls 32A and 32B are shown with such a size that the exterior edges 33 and 35 meet in abutting relationship. Alternatively, the upper walls 32A and 32B may be sized so that the exterior edges 33 and 35 instead overlap each other, or do not touch each other. The overlapping arrangement is particularly suited for use when the support members 30 are to be constructed as freestanding units for later attachment to a pallet base 12, since overlapping exterior edges 33 and 35 make the upper walls 32A and 32B easier to attach to each other. On the other hand, when the upper walls 32A and 32B are to be attached solely to the pallet base 12 rather than to each other, the exterior edges 33 and 35 need not abut or overlap each other. Thus, the upper walls 32A and 32B can be of smaller size, with each upper wall 32A or 32B merely forming a flap or lip suitable for attachment to the pallet base 12. Nevertheless, the support member 30 configuration of FIGS. 6 and 7 and the abutting relationship of the exterior edges 33 and 35 shown in FIGS. 1–3 and 5–7 is recommended because it allows the side walls 36 and 38 to automatically be placed in parallel relationship. Parallel side walls 36 and 38 assist the support member 30 in easily folding into a collapsed state.

Figure 12:
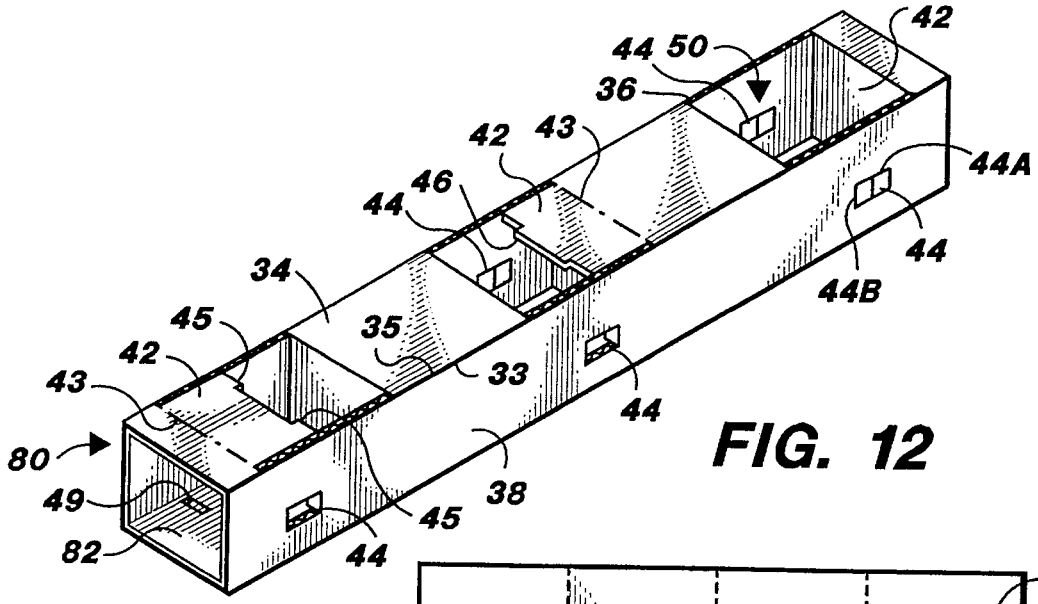
FIG. 12 is a perspective view of the underside of a second embodiment of a support member of the pallet of FIG. 1.
Figure 13:
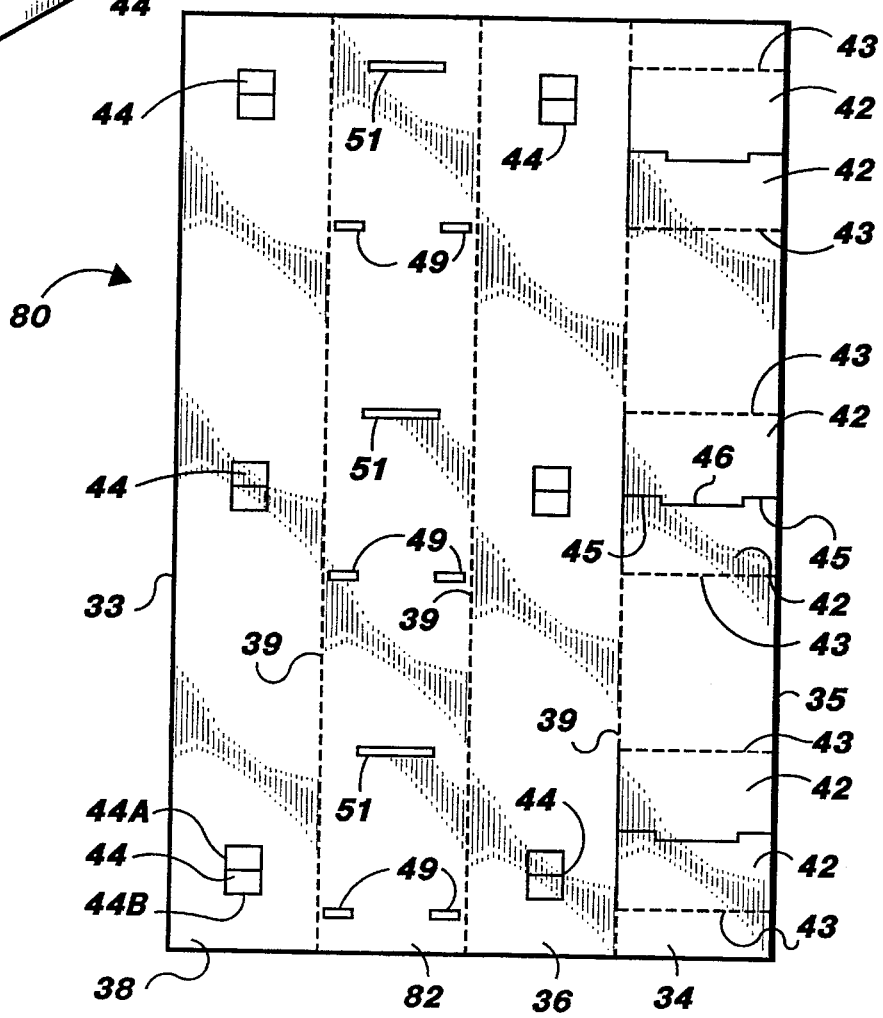
FIG. 13 is a top plan view of the unfolded support member of FIG. 12.

Fourth, it is contemplated that the exterior edges 33 and 35 of the support member 30 may be located at different points along the lengths of the upper walls 32A and 32B, the side walls 36 and 38, and the lower wall 34. As an example, FIGS. 12 and 13 illustrate a support member 80 which is similar to the support member 30 of FIGS. 6 and 7, but wherein the upper walls 32A and 32B are instead a unitary upper wall 82. One exterior edge 33 is located on side wall 38, and the other is located on the lower wall 34. The edges 33 and 35 may be joined together by the aforementioned attachment means to form a freestanding support member 80. The support member 80 may then be affixed to the pallet base by attaching the upper wall 82 to the lower surface 16 of the pallet base 12 by use of attachment means.

Fifth, it is contemplated that the collapsible support members 30 may be made of different material than corrugated fiberboard or cardboard. As an example, FIG. 14 illustrates a support member 100 which can be made of durable materials such as plastics, fiberglass, metals or other hard planar materials. Support member 100 walls made of these materials typically require hinged supports in order to allow the support member 100 to fold flat. Thus, support member 100 includes a plurality of hinges 102 to manipulate the support member 100 from the collapsed position to the upright position. The hinges 102 can be any typical hinge known to the art for this purpose. Preferred hinges 102 include piano-type hinges. A piano hinge can be of any sufficient length to both connect the walls of the support member 100 and enable the walls to fold. The support member 100 is then temporarily or permanently attached to a planar pallet base 12 by use of attachment means such as fasteners, adhesives, welding, or other attachment means known to the art.

In an alternative embodiment, it is contemplated that the exterior support members 30 may be formed integrally with the sides 22 and 24 of the pallet base 12. This especially efficient and preferred embodiment is illustrated as pallet 110 in FIGS. 13–16. The collapsible pallet 110 includes an integrally formed pallet unit 112 and at least one support member such as the support members 30, 80 or 100 described above. The pallet unit 112 includes two opposing support member portions 114A and 114B with a base portion 116 resting therebetween. The support member portion 114A includes a first sidewall area 118A, a lower wall area 120A, a second sidewall area 122A, and an upper wall area 124A, all separated by fold lines 126. Similarly, the support member portion 114B includes a first sidewall area 118B, a lower wall area 120B, a second sidewall area 122B, and an upper wall area 124B, all separated by fold lines 126. These areas are preferably formed similarly to the upper walls 32A and 32B, lower wall 34, and side walls 36 and 38 of the support members 30 shown in FIGS. 7 and 13. For example, the first sidewall areas 118A and 118B and second sidewall areas 122A and 122B each preferably include locking tabs 44, the lower wall areas 120A and 120B each preferably include support flaps 42, and the upper wall areas 124A and 124B each preferably include receiving slots 49 and 51. The base portion 116 includes an upper surface 128 and a lower surface 130 bounded by a front end 132, a rear end 134, and opposing sides 136 and 138 which are each joined to the first sidewall areas 118A and 118B, respectively.

Figure 15:
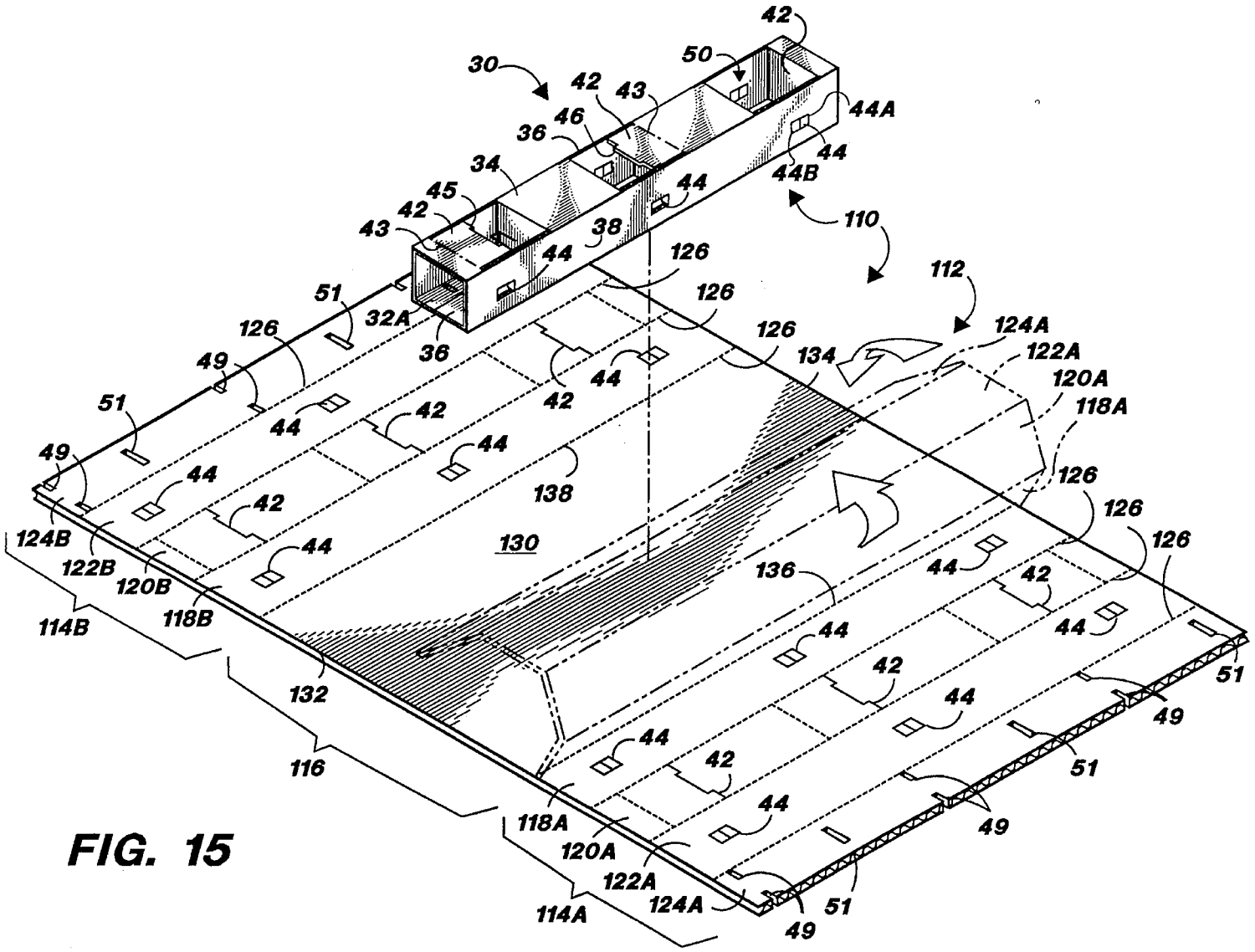
FIG. 15 is an exploded perspective view of the underside of an alternative embodiment of the pallet of FIG. 1.
Figure 16:
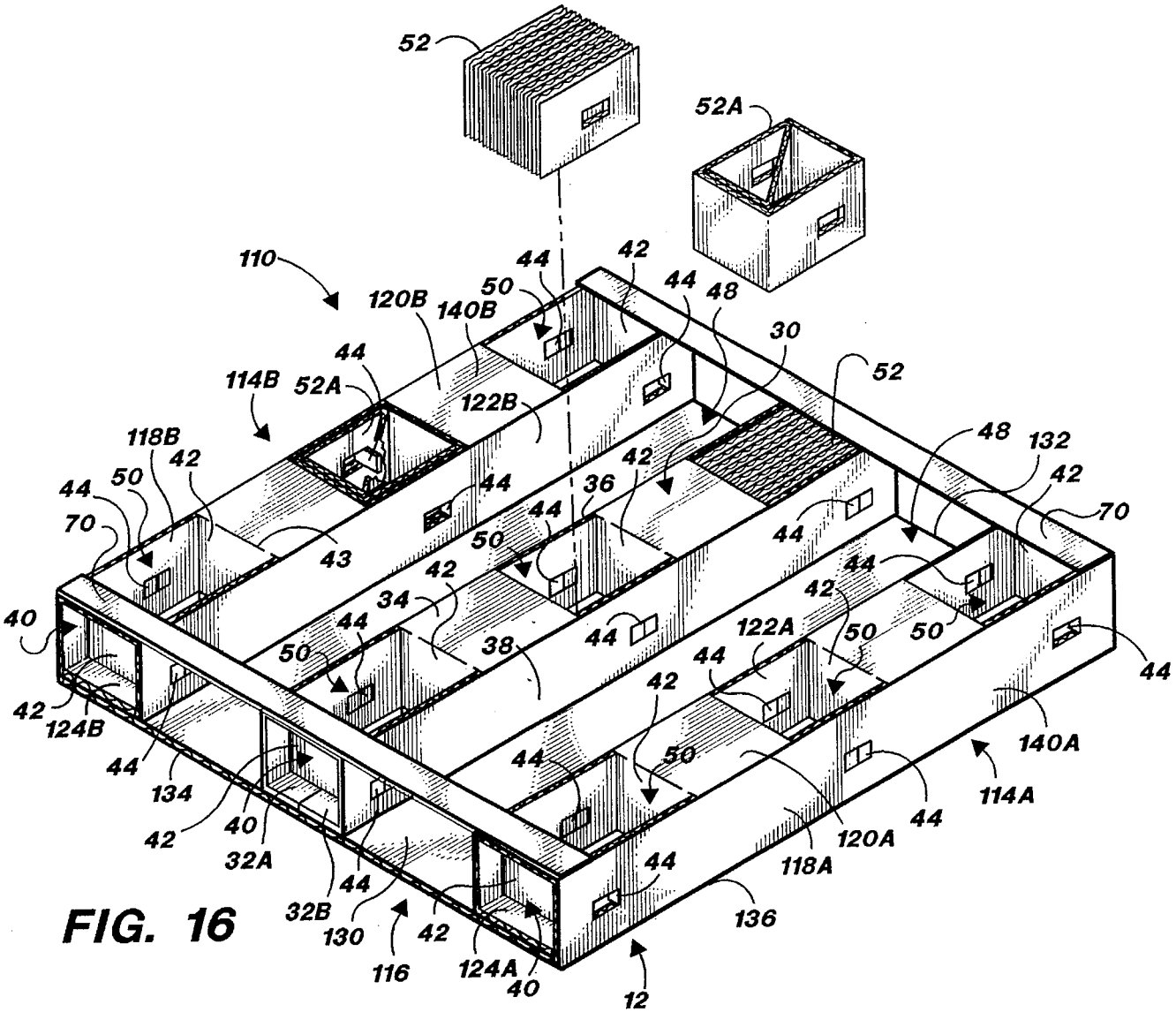
FIG. 16 is a perspective view of the underside of the assembled pallet of FIG. 15.
Figure 17:
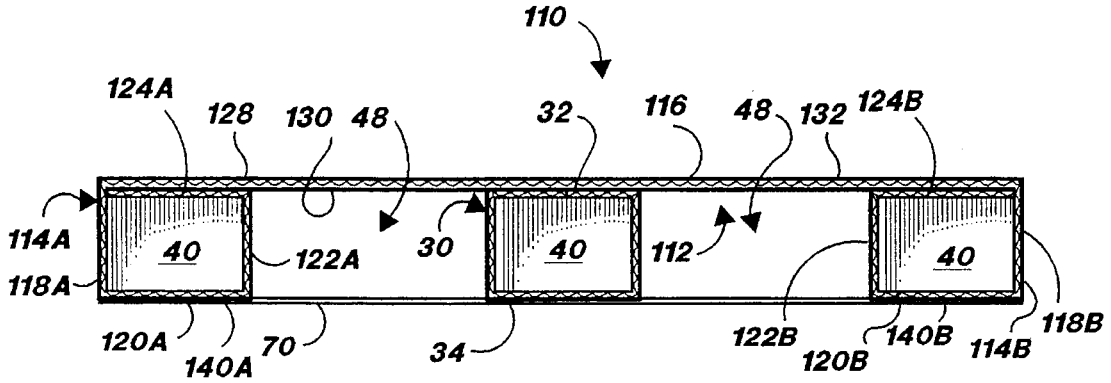
FIG. 17 is an end elevated view of the pallet of FIG. 15.
Figure 18:
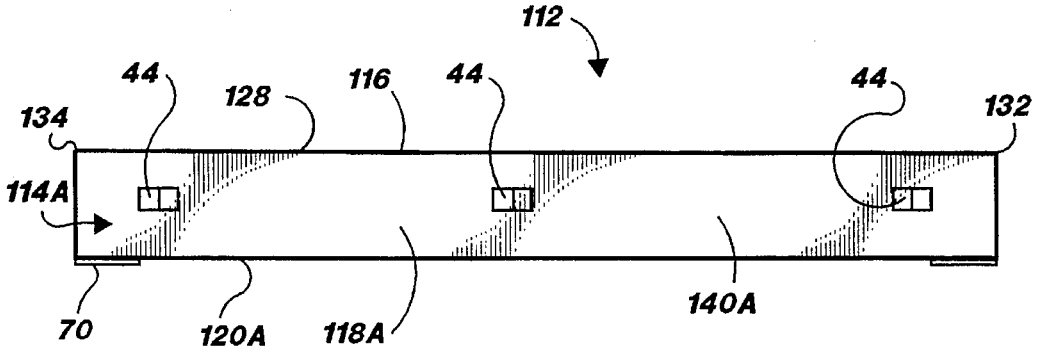
FIG. 18 is a side elevated view of the pallet of FIG. 15.

To form the collapsible pallet 110, the first sidewall area 118A, lower wall area 120A, second sidewall area 122A, and upper wall area 124A are folded into a boxlike configuration wherein the first and second sidewall areas 118A and 122A are placed in parallel opposing positions with the lower wall area 120A parallel to the upper wall 124A. The upper wall area 124A is placed against the lower surface 130 of the base portion 116 and affixed to the lower surface 130 by use of attachment means. The support member portion 114B is then similarly folded and its upper wall area 124B is similarly affixed to the lower surface 130. By performing these steps, collapsible support members 140A and 140B are formed. To complete the pallet 110, a support member 30 may be attached to the lower surface 130 between the support members 140A and 140B. Support means such as the support flaps 42 and/or support blocks 52 or 52A may be deployed, and a crossbeam 70 may be attached to the support members to complete the collapsible pallet 110. The completed collapsible pallet 110 is shown in FIGS. 14–16.

The collapsible pallet 110 has several advantages over the collapsible pallet 10. Initially, it uses less material and it is faster and easier to construct than the pallet 10. However, use of an integral pallet unit 122 also allows several structural advantages.

First, by forming the support members 140 of the pallet 110 integrally with the base portion 116, the exterior support members 140 are automatically aligned in parallel fashion. This helps the support members 140 to collapse more easily when the support means are removed.

Second, the strength of attachment between the base portion 116 and the support members 140 of the pallet 110 will inherently be greater than the strength of attachment between the pallet base 12 and support members 30 of the pallet 10. The base portion 116 and support members 140 of the pallet 110 are integrally formed, whereas the pallet 10 may have an exposed attachment seam 26 on the sides 22 and 24 between the pallet base 12 and external support members 30. However, the pallet 110 does not have this exposed seam 26 between the base portion 116 and the support members 140. Also, while the seam 26 in the collapsible pallet 10 could be protected by such means as spacing the support members 30 inward from the sides 22 and 24 of the pallet base 12 and then folding the sides 22 and 24 downward and attaching them to the side walls 36 or 38 of the support members 30, such a solution utilizes more material than the solution presented by the pallet 110.

The support members 140 of the pallet 110 should be made of the same material as the base portion 116. Nevertheless, if the user desires a pallet base made of a different type of material than the support members 140, the user may affix a different type of pallet base 12 atop the base portion 116 by use of attachment means.

In addition to using alternate embodiments of the support members 30, it is contemplated that the collapsible pallet of the present invention may also use alternate embodiments of the pallet base 12.

As one example, while the pallet base 12 has been depicted as having a square or rectangular shape, it could instead use other shapes, such as a circular one.

Further, it has already been noted that additional support members 30 may be added to the collapsible pallet 10 to strengthen it. Alternatively or in addition to the use of additional support members 30, the collapsible pallet 10 may be reinforced by adding additional sheets of material to the upper surface 14 of the pallet 10 atop the first pallet base 12, or even on the underside of the pallet 10 on the lower wall 34 of the support members 30. This latter option provides a collapsible pallet 10 which is particularly suitable for use in roller conveyor systems. In this embodiment, a sheet much like the pallet base 12 is affixed to the lower walls 34 of the support members 30. This sheet may include cutout portions to allow access to the support means. However, despite the presence of the cutout portions, this sheet will provide a large, flat surface on the bottom of the pallet 10. This sheet enables the pallet 10 to better travel on a conveyor system because the large, flat surface prevents the support members 30 from creating drag as they engage different rollers.

Figure 19:
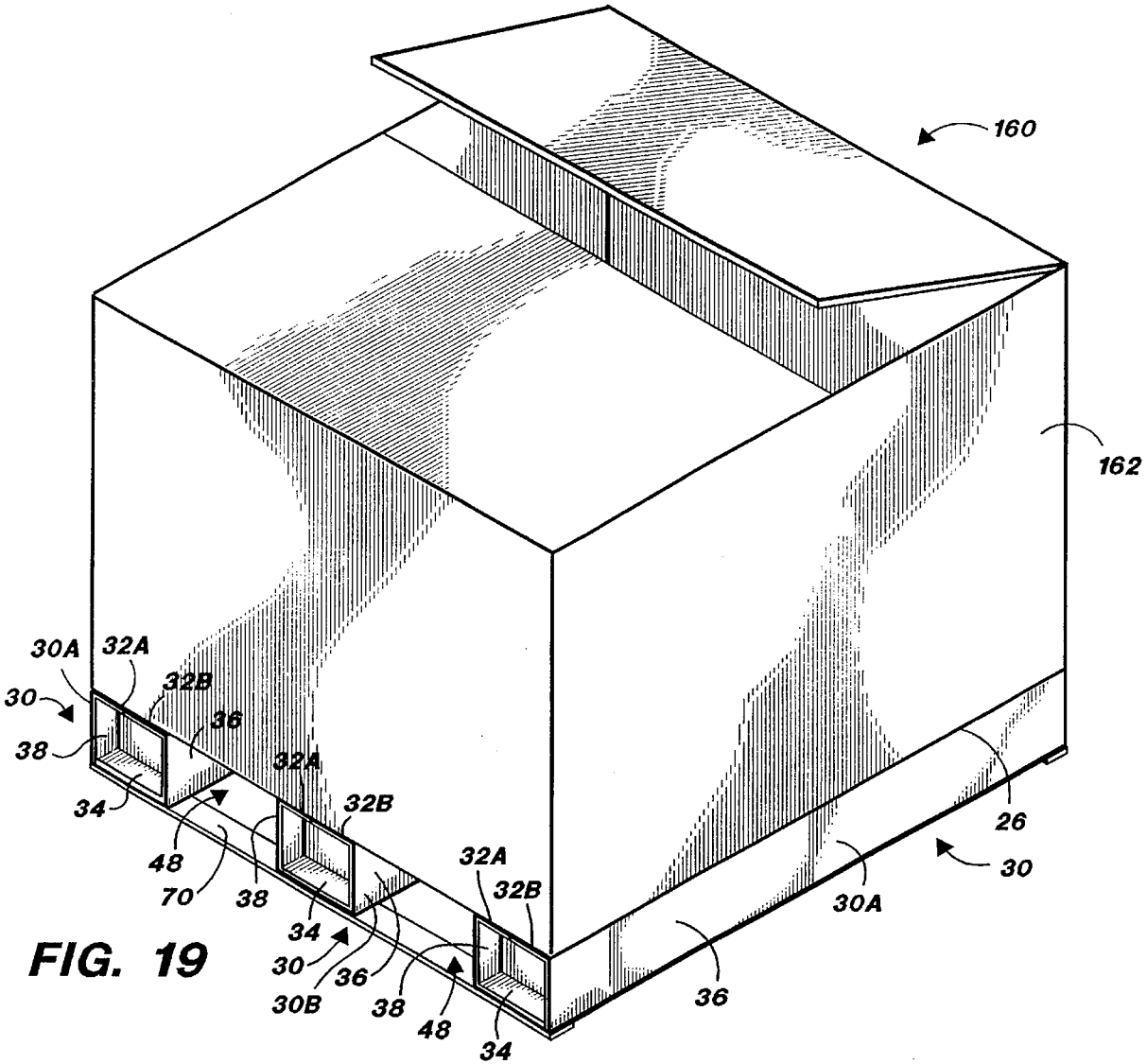
FIG. 19 is a perspective view of the support members of FIG. 6 attached to the underside of a box.

As another example, the pallet base 12 may be made of different materials than the support members 30 in order to obtain a desired surface characteristic at the upper surface 14. As one example, the support members 30 may be made of fiberboard, and the pallet base 12 may be made of rubber sheet or be covered or coated with suitable materials to prevent slippage of cargo. As another example, the pallet base 12 can be comprised of corrugated fiberboard while the attached support members 30 or 100 can be made of a metal or plastic material. This feature is helpful when the matter that the pallet base 12 supports, and/or the environment that the support member 100 rests upon, call for special materials to enable the matter to be effectively transported. For example, the support members 100 may need to be resistant to corrosion, while the pallet base 12 may need to be made of a semirigid shock-absorbing material. In such a case, the support members 100 could be made of stainless steel and the pallet base 12 could be made of vulcanized rubber, among other materials, Additionally, the pallet base 12 may have walls which are foldably or rigidly attached to its front end 18, rear end 20, and sides 22 and 24. As an example, the pallet base 12 may have upwardly extending connected sidewalls at its ends 18 and 20 and sides 22 and 24 so that the pallet base 12 itself forms the base of a box. Such an arrangement forms a palletized box 160, as shown in FIG. 19. This palletized box can be easily constructed by using attachment means to install the support members 30 on the base of a box 162. The advantage of the palletized box 160 is that the support members 30 may be installed on the box 162 either before or after the box 162 has been filled. Thus, a filled and prepackaged box 162 can be "retrofit" with support members 30 to protect the material within the box from the ground environment. FIG. 19 illustrates but one embodiment of many of the palletized boxes that may be made with the present invention, and instead support members such as support member 80 or support member 100 may be affixed to the base of the box 162, or the base of the box 162 may be affixed to the pallet base 12 of pallets such as pallet 10 or pallet 110.

The pallet 10 may be plastic coated or otherwise waterproofed so that the pallet 10 is moisture resistant. This feature is helpful when the pallet 10 will be used in wet packaging or shipping areas or when it will be stored outdoors. As an example, the pallet materials can be coated with polyethylene. Additionally, the pallet 10 can be impregnated or coated with fire resistant and/or vermin resistant chemicals by prior art spraying or dipping processes.

While the present invention has been described with respect to preferred embodiments, it is understood that the present invention is not limited to the disclosed embodiments. Rather, this invention includes a variety of modifications and equivalent features included within the spirit and scope of the claims. The scope of the following claims is to be accorded the broadest interpretation so as to encompass all such modifications and equivalent structures and functions.

What is claimed is:

1. A collapsible pallet comprising:

a. a pallet base including opposing upper and lower surfaces;

b. a support member having a generally rectangular shape defined by opposing first and second ends and opposing first and second sides, the support member including:

(1) contiguous foldably attached walls defining an upper wall, an opposing lower wall, and first and second opposing side walls, wherein the upper wall and the lower wall are foldably connected to the first and second side walls to form an internal channel having two opposing ends; and (2) at least one foldable support flap integrally connected to the lower wall and adapted to fold inwardly into the internal channel and thereby define a support compartment within the internal channel which opens onto the lower wall, the support flap having an edge which includes at least one locking tongue thereon;

wherein the upper wall is attached to the lower surface of the pallet base, and further wherein the upper wall includes at least one receiving slot therein, each receiving slot being sized to releasibly receive one locking tongue therein when the support flap is folded into the internal channel.

2. The support member of claim 1 wherein the support flap is spaced from the ends of the internal channel.

3. The support member of claim 1 wherein the upper wall includes abutting axially oriented edges.

4. The support member of claim 1 in combination with a support block sized to snugly fit within the support compartment, and further wherein at least one of the side walls includes at least one locking tab adapted to releasibly secure the support block within the support compartment.

5. The support member of claim 1 in combination with a support block adapted to snugly fit within at least a portion of the internal channel.

6. The support member of claim 1 including at least one pair of support flaps which are positioned in opposing relation, whereby the support flaps within each pair may be folded into the internal channel in parallel spaced relation to define the support compartment therebetween.

7. A collapsible pallet comprising:

a. a pallet base having upper and lower surfaces; and b. at least two elongated collapsible support members, each support member including contiguous foldably attached walls defining an upper wall, an opposing lower wall, and first and second opposing side walls, wherein the upper wall and the lower wall are foldably connected to the first and second side walls to form an internal channel having two opposing ends, wherein the upper wall is attached to the lower surface of the pallet base and includes at least one receiving slot therein, and further wherein the lower wall includes at least one foldable support flap adapted to fold inwardly into the internal channel and thereby define a support compartment within the internal channel which opens onto the lower wall, the support flap having an edge which includes at least one locking tongue thereon;

whereby the support flap may be folded inwardly into the internal channel so that the receiving slot releasibly receives the locking tongue.

8. The collapsible pallet of claim 7 wherein the support members are integrally attached to the pallet base.

9. The collapsible pallet of claim 7 wherein the support members are attached to the pallet base by use of attachment means.

10. The collapsible pallet of claim 7 wherein the upper wall includes abutting axially oriented edges.

11. The collapsible pallet of claim 7 wherein the support members are spaced in parallel position to define fork channels therebetween.

12. The collapsible pallet of claim 7 in combination with a support block sized to snugly fit within the support compartment, wherein at least one of the side walls includes at least one locking tab adapted to releasibly secure the support block in the support compartment.

13. The collapsible pallet of claim 7 in combination with a support block sized to be received in the support compartment in a snug-fit manner.

14. The collapsible pallet of claim 7 wherein the support flap is spaced from the ends of the internal channel.

15. The collapsible pallet of claim 7 wherein each support member includes at least two support flaps disposed in opposing relation so as to define the support compartment between opposing support flaps.

16. The collapsible pallet of claim 7 further comprising at least one crossbeam connected to the support members.

17. The collapsible pallet of claim 7 wherein the pallet base is planar.

18. The collapsible pallet of claim 7 wherein the pallet base further comprises a box base having box sidewalls extending therefrom.

19. A collapsible pallet comprising:

a. a pallet base having an upper surface, a lower surface, a first end, a second end, and first and second opposing sides; and b. at least two elongated collapsible support members each support member including an upper wall connected to the pallet base, an opposing lower wall, and first and second opposing side walls, wherein the lower wall is foldably connected to the first and second side walls and the upper wall is foldably connected to at least one of the first and second side walls to define an internal channel having two opposing ends, wherein the upper wall includes at least one receiving slot therein, and wherein the lower wall includes at least one folding support flap extending between the first and second side walls and bearing a locking tongue thereon, each support flap being adapted to fold inwardly into the internal channel with the locking tongue releasibly fit within the receiving slot, thereby maintaining the side walls in spaced relation and forming a support compartment in the internal channel which opens onto the lower wall.

20. The collapsible pallet of claim 19 wherein the support flap is spaced from the ends of the internal channel.

21. The collapsible pallet of claim 19 in combination with a support block comprising an elongated member folded in such a manner as to fit snugly within the support compartment.

22. The collapsible pallet of claim 21 wherein at least one side wall includes at least one locking tab adapted to fold into the support compartment to releasibly secure the support block therein.

23. A collapsible pallet comprising:

a. a planar pallet base having an upper surface, a lower surface, a first end, a second end, and first and second opposing sides;

b. at least two elongated support members attached to the pallet base and spaced in parallel position to define a fork channel therebetween, wherein each support member includes an upper wall attached to the lower surface of the pallet base, an opposing lower wall, and opposing first and second side walls therebetween, wherein the upper wall and the lower wall are foldably connected to the first and second side walls to define an internal channel;

c. at least one folding support flap on the lower wall of each support member, each folding support flap being adapted to fold into the internal channel and abut the upper wall, thereby defining a support compartment adjacent each support flap within each internal channel;

d. at least one receiving slot on the upper wall of each support member, each receiving slot being sized to releasibly receive an edge of the support flap when the support flap is folded into the internal channel;

d. at least one support block, each support block being sized to releasibly fit within one support compartment.

24. The collapsible pallet of claim 23 wherein the support block is a solid block adapted to be received in the support compartment in a snug-fit manner.

25. The collapsible pallet of claim 23 wherein the support block is an elongated member folded in such a manner as to fit snugly within the support compartment.

26. The collapsible pallet of claim 23 wherein at least one of the side walls includes at least one locking tab for releasibly securing one support block within one support compartment.

27. The collapsible pallet of claim 23 further including at least one longitudinally extending crossbeam connected to the support members.

28. A collapsible pallet comprising:

a. a pallet base portion having an upper surface, a lower surface, a first end, a second end, and two opposing sides with support member portions extending therefrom, wherein the support member portions include a first side wall area foldably connected to the pallet base portion, a lower wall area foldably connected to the first side wall area, a second side wall area foldably connected to the lower wall area, and an upper wall area foldably connected to the second side wall area, wherein the wall areas are adapted to fold so that the lower wall area and upper wall area rest parallel to the lower surface, and the side wall areas are in parallel relation, thereby defining an internal channel between the side wall areas;

wherein the lower wall area includes at least one foldable support flap adapted to fold upwardly into the internal channel to thereby define a support compartment within the internal channel, the support compartment opening onto the lower wall area;

wherein the support flap includes an edge having at least one locking tongue thereon, and wherein the upper wall area includes at least one receiving slot therein, wherein the locking tongue may be releasibly fit when the support flap is folded upwardly into the internal channel; and b. at least one support block, each support block being sized to releasibly fit within one support compartment.

29. The collapsible pallet of claim 28 wherein the internal channel has two opposing ends and the support flap is spaced from the ends of the internal channel.

30. The collapsible pallet of claim 28 wherein the upper wall area is attached to the lower surface of the pallet base by use of attachment means.

31. The collapsible pallet of claim 28 in combination with a support member attached to the lower surface between the support member portions.

* * * * *